US005662325A

United States Patent [19]

Weyand

[11] Patent Number: 5,662,325

[45] Date of Patent: Sep. 2, 1997

[54] SYSTEM FOR GENERATING RANDOM OUTCOMES USING DISCS

[76] Inventor: Rudi Weyand, 16776 Bernardo Center Dr., Ste. 110B, San Diego, Calif. 92128

[21] Appl. No.: 580,638

[22] Filed: Dec. 29, 1995

Related U.S. Application Data

[63] Continuation-in-part of Ser. No. 349,549, Dec. 5, 1994, Pat. No. 5,480,150.

[51] Int. Cl.[6] ..... A63F 3/00

[52] U.S. Cl. ..... 273/138.1; 273/244; 273/244.1; 273/246; 273/243; 273/290; 273/291

[58] Field of Search ..... 273/288, 290, 273/291, 243, 249, 248, 144 R, 393, 424, 93 R, 144 A, 144 B, 148 R, 294, 138.1

[56] References Cited

U.S. PATENT DOCUMENTS

| | | | |
|---|---|---|---|
| 2,026,682 | 1/1936 | Jeffries | 273/144 R |
| 3,211,458 | 10/1965 | Wells et al. | 273/248 |
| 3,749,404 | 7/1973 | Oetzel | 273/243 |
| 5,340,113 | 8/1994 | Respicio | 273/249 |

*Primary Examiner*—Benjamin H. Layno
*Attorney, Agent, or Firm*—Brown, Martin, Haller & McClain

[57] ABSTRACT

Discs bearing markings or other indicators that differentiate them from each other are used to randomly select one of a number of possible outcomes. The discs may thus be used to introduce an element of chance in games. Each disc has two sides, one of which is marked with a number. The discs may be grouped into sets. The number marked on each disc in a set is the same as that of all other discs in that set, but is different from that of all discs in other sets. To use the discs to randomly select an outcome, a person stacks all the discs on top of one another. The person then topples the stack by tossing a heavier or larger disc at the stack. The outcome may be used to play a board game. Each disc may have several distinct types of indicators. Each indicator type may correspond to a different game, and each indicator type may be used in a different way to determine the outcome of that game. Alternatively, an indicator type may be used to determine a number of spaces to move a playing piece on the game board. The player may stack the discs and topple them a second time, and then use a different indicator type to determine the outcome of moving the playing piece to that space.

27 Claims, 6 Drawing Sheets

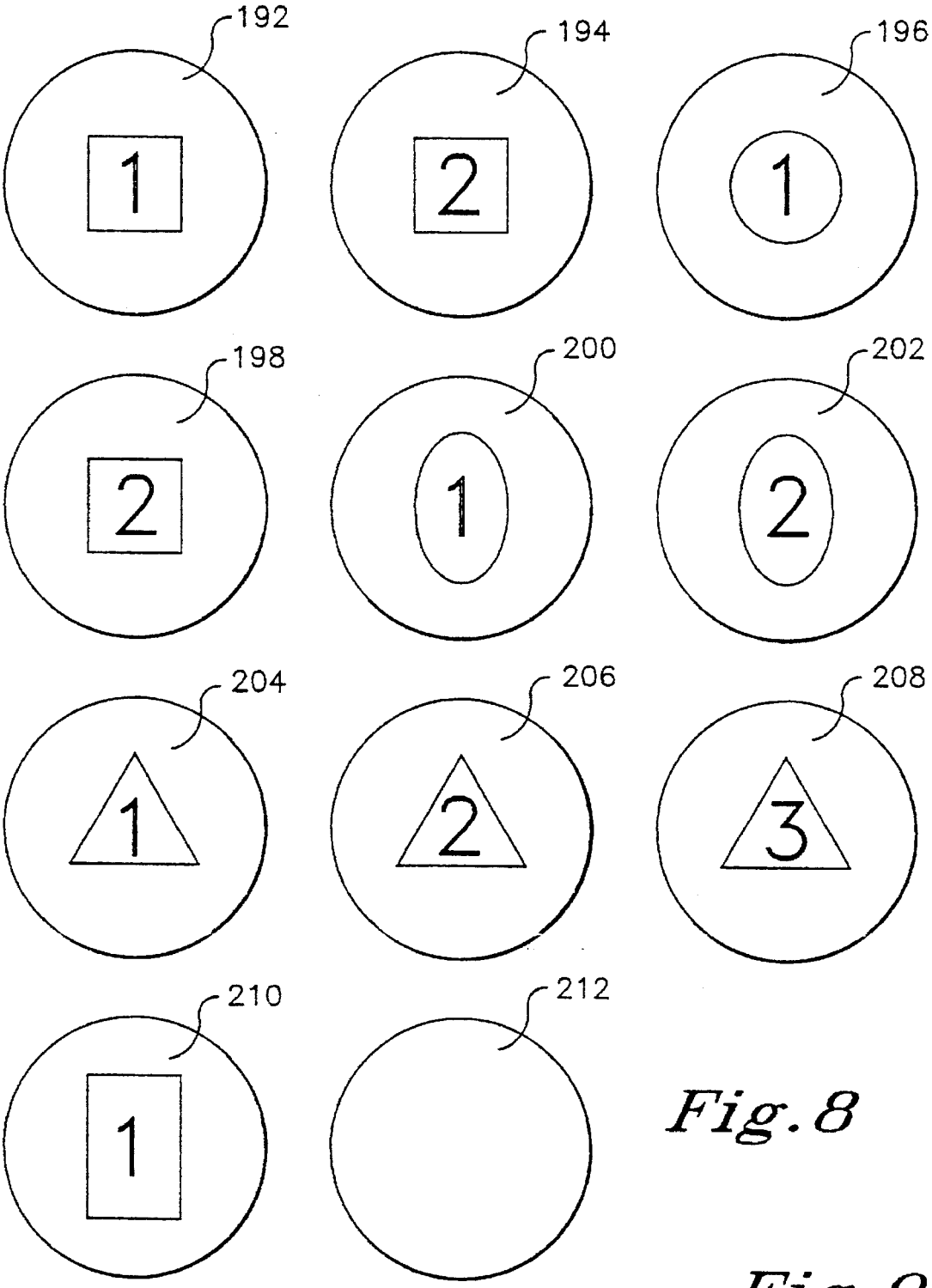
Fig. 8
Fig. 9
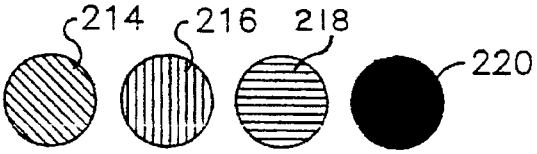
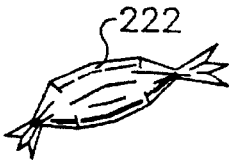
Fig. 10

SYSTEM FOR GENERATING RANDOM OUTCOMES USING DISCS

CROSS-REFERENCE TO RELATED APPLICATION

This is a continuation-in-part of application Ser. No. 08/349,549, filed Dec. 5, 1994, now U.S. Pat. No. 5,480,150.

BACKGROUND OF THE INVENTION

Random outcome generators may be used to introduce an element of chance in board games and other games played for entertainment. Dice are probably the most common random outcome generators used for this purpose, although wheels and other devices are also used. A die is a polyhedron that has a number or other indicator imprinted, engraved or otherwise disposed on each of its sides. Each number or indicator is different. When the die is rolled on a flat surface, it comes to rest on one of its sides with another one of its sides facing upward. The number on the upwardly facing side determines the outcome of the roll and is essentially random. Although the most commonly used dice have six sides (hexahedrons or cubes), dice having as many as ten sides (decahedrons), twelve sides (dodecahedrons) or even twenty sides (icosahedrons) are also known.

Dice having a large number of sides are inconvenient to use. The larger the number of sides, the smaller the area of each in relation to the overall size of the die. It is difficult to imprint or engrave numbers or other indicia on very small areas. Furthermore, it is difficult to discern very small indicia. Moreover, the area of the surface on which the die rests must be flat to discern which side is facing upward; the smaller the area of the sides, the flatter the surface must be. Turf, concrete, asphalt, tile and similar rough surfaces are unsuitable for rolling ten or twenty-sided dice of typical size.

Coins have been used to randomly select one of two possible outcomes. Coins are discs having an obverse side and a reverse side, commonly known as a "head" and a "tail," respectively. The head and tail bear different indicia. (The obverse or "head" sides of many coins bear a bust or likeness of a person's head, while the reverse side does not.) When the coin is tossed on a relatively flat surface, it lands with either its obverse or reverse side facing upward. Coins are advantageous because a person can toss a coin of typical size on nearly any surface without experiencing difficulty discerning which side is facing upward. Nevertheless, the use of a coin is limited to generating one of two possible numbers or outcomes. Coins are therefore not used to generate random outcomes in board games and the like.

A game known as "pog" is played using milk-bottle caps or similarly sized discs. The discs, also known as pogs, are stacked on top of one another. The obverse and reverse sides of each pog bear different indicia, and all the pogs are stacked with their obverse sides facing upward. A player tosses another pog, which is sometimes called a "slammer" and which is typically heavier or larger, at the stacked pogs. The stack or a portion of it topples as a result of the impact with the slammer. The player gathers and keeps any pogs that have flipped over, i.e., those that have landed on the ground with their reverse sides up. The remaining pogs are re-stacked, and the player's opponent then takes a turn in the same manner, keeping any pogs that have flipped over. When all pogs have been flipped over, the player with the most pogs wins the game.

SUMMARY OF THE INVENTION

The present invention comprises a plurality of sets of discs bearing indicia that differentiate them from each other as described below, and a method for using the discs to randomly select one of a predetermined number of outcomes. The discs may thus be used to introduce an element of chance in games.

Each disc is a substantially flat piece of a suitable material having exactly two sides. The perimeter of the disc may be circular, square, hexagonal, octagonal or any other shape, including irregular shapes. One side of each disc has indicia formed in any suitable manner, such as printing, embossing, molding and the like.

In accordance with one aspect of the present invention, the indicia of each disc in a set may be the same as that of all other discs in that set, but different from that of all discs in other sets. Although any indicia are suitable, in an exemplary embodiment, the indicia comprise arabic numerals or other symbols that a person can readily associate with a numeric value. The other (non-indicia) sides of the discs may be solid colors, patterns or any other designs and may be uniform among all discs or vary among discs, so long as all of the non-indicia sides can be readily distinguished from the indicia sides.

To use the discs to randomly select an outcome, a person stacks all the discs on top of one another. The discs may be stacked in a uniform orientation, i.e., with the indicia sides of all discs facing either upwardly or downwardly, in a predetermined non-uniform orientation, or in random orientations, i.e., randomly or without regard to orientation. The person then upsets the stack. In an exemplary embodiment, the stack is upset by tossing another, preferably heavier or larger, disc at the stack. After the stack topples or is otherwise upset, the person counts the number of discs in each set that have come to rest in a predetermined orientation. In other words, the person either counts the number of discs in each set that have come to rest with their indicia sides facing upwardly or counts the number of discs in each set that have come to rest with their indicia sides facing downwardly.

The person uses these set counts and a predetermined relationship to determine the outcome. A predetermined relationship for a board game, for example, may include a correspondence between each different combination of set counts and the number of spaces to move a playing piece on the board.

The sets of discs may, in an exemplary embodiment, be used to generate random numbers as an intermediate step prior to determining an outcome. The predetermined relationship may include a correspondence between each of the indicia and a numeric value. A person may multiply the count corresponding to each set by the numeric value corresponding to its indicia and sum the results together to generate a numeric result. It should be noted that counting the number of discs in a set that have come to rest in a predetermined orientation and multiplying that count by a numeric value corresponding to their indicia is equivalent to summing the numeric values corresponding to the indicia of those discs. As used herein, counting discs or forming a count of discs refers only to determining the number of such discs, a step that is inherently performed when a person sums or adds together a plurality of equal numeric values. The predetermined relationship also includes a correspondence between the possible numeric results and different outcomes. For example, a predetermined relationship for a board game may include a correspondence between the numeric results and the number of spaces to move a playing piece on the board.

In accordance with another aspect of the present invention, each disc may have multiple types of indicia. The indicia types may be any shapes, colors, symbols or other features that a person can readily compare with each other to determine which indicia of a disc belong to each indicia type. For example, discs may have indicia of a first type that consist of red arabic numerals and indicia of a second type that consist of blue arabic numerals. In another example, discs may have indicia of a first type that consist of arabic numerals and indicia of a second type that consist of polygonal symbols in which each numeral is enclosed. The numerals, symbols, colors or indicia of other types may be distributed in sets in accordance with the aspect of the invention described above regarding sets.

Each indicia type may correspond to a different game, and each indicator type may be used in a different way to determine the outcome of that game. Thus, the present invention may be used to determine random outcomes for different games or different stages or phases of a single game. Alternatively, a first indicia type may be used to determine a number of spaces to move a playing piece on a game board, and a second indicia type may be used to determine the outcome of moving the playing piece to that space.

Although the word "random" is used herein, the degree of randomness of the outcome depends upon several factors. The relative numbers of discs in the sets, the manner in which the discs are stacked and the manner in which they are toppled will all affect the probability distribution of the outcomes. By altering these factors, persons of skill in the art can produce a distribution in which the probability of each outcome is approximately the same. Such a distribution would allow the present invention to be used to emulate the Operation of dice. Nevertheless, in many games it is desirable to weight the probability of some outcomes more heavily than others. Persons of skill in the art will readily be capable of producing a desired probability distribution.

The foregoing, together with other features and advantages of the present invention, will become more apparent when referring to the following specification, claims, and accompanying drawings.

BRIEF DESCRIPTION OF THE DRAWINGS

Understanding of the present invention will be facilitated by consideration of the following detailed description of a preferred embodiment of the present invention, taken in conjunction with the accompanying drawings, in which like reference numerals refer to like parts and in which:

FIGS. 8, 9 and 10 are top plan views, respectively, of discs, playing pieces and candy pieces for the Halloween game.

DETAILED DESCRIPTION OF A PREFERRED EMBODIMENT

Figure 1A:
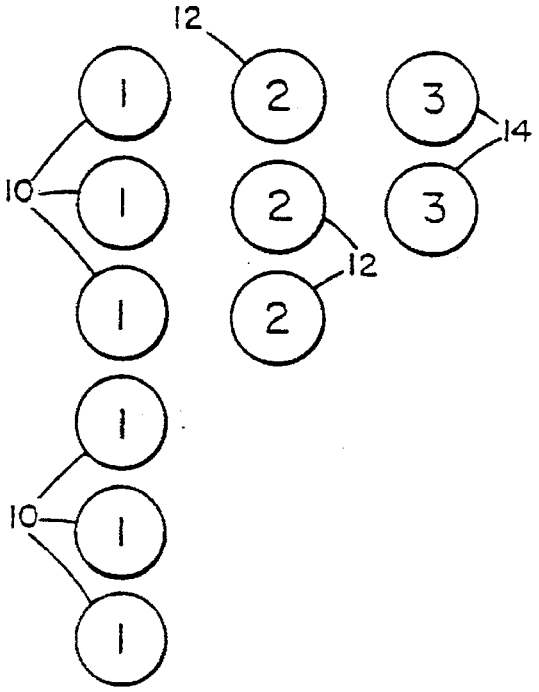
FIG. 1A is a top plan view of the discs.
Figure 1B:
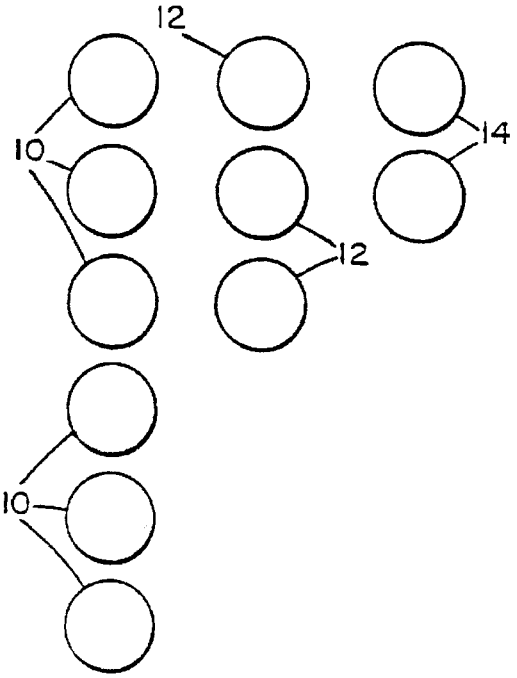
FIG. 1B is a bottom plan view of the discs.

As illustrated in FIG. 1A–B, six discs 10 define a first set of discs, three discs 12 define a second set of discs, and two discs 14 define a third set of discs. The discs may be made of any suitable material, such as cardboard. As illustrated in FIG. 1A, the obverse sides or indicia sides of discs 10, 12 and 14 are labeled respectively with the arabic numerals "1," "2" and "3." The numerals allow a person to readily distinguish the discs of each set from the discs of the other sets. Each set thus consists of discs having the same indicia as all other discs in the set but different from that of discs in the other sets. Although in the illustrated embodiment discs 10–12 are labeled with arabic numerals, any indicia that allow a person to distinguish the discs of a set from those of the other sets are suitable. For example, the discs may have different colors, illustrations, patterns, or abstract designs. As illustrated in FIG. 1B, the reverse sides of discs 10–12 are blank and thus not labeled with any of the numerals or indicia that appear on the obverse sides of discs 10–12. Although in the illustrated embodiment, the reverse sides of discs 10–12 are blank or a uniform color, they may bear any designs or markings that are distinguishable from the indicia on the first sides of discs 10–12.

Figure 2A:
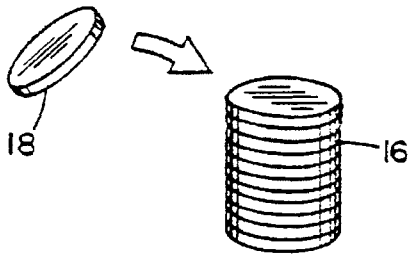
FIG. 2A is a perspective view of the stacked discs and an additional disc being tossed at them.
Figure 2B:
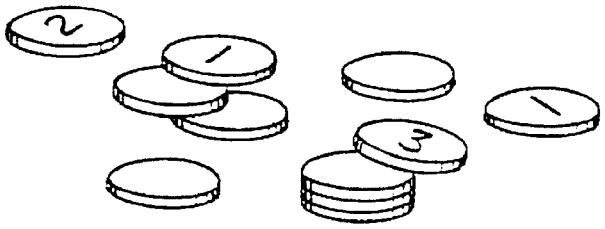
FIG. 2B is a perspective view of the toppled stack of discs.

As illustrated in FIG. 2A, discs 10, 12 and 14 are stacked on top of each other in random order to form a stack 16, with discs 10–12 having their obverse or indicia sides facing downward. Another disc 18, which is preferably made of a heavier material than discs 10–12, is tossed at or dropped onto stack 16. The impact between disc 18 and stack 16 topples stack 16 and scatters discs 10–12. The scattered discs 10–12 come to rest with either their indicia sides or non-indicia sides facing upward, as illustrated in FIG. 2B. The number of discs 10 resting with their indicia sides facing upward are counted, as are the number of discs 12 and the number of discs 14 resting with their indicia sides facing upwardly.

The following chart may be used to convert the counts of discs 10–12 resting with their indicia sides facing upwardly into an outcome. The chart relates the possible counts of upwardly facing discs to possible outcomes in a simulated game of baseball. This simulated baseball game is intended only as an illustration of a game in which a random outcome is required. Other games in which random outcomes are generated include MONOPOLY®, PARCHEESI®, TWISTER® and the like. In view of the teachings herein, all such games in which the present invention may be used will be readily apparent to persons of skill in the art.

| | |
|---|---|
| 1 = Ball | 10 = Ball |
| 2 = Foul Ball | 11 = Ground Out |
| 3 = Single | 12 = Steal/Ball |
| 4 = Pop Out | 13 = Triple |
| 5 = Squeeze Play/Ball | 14 = Ball |
| 6 = Single | 15 = Pop Out/Bunt |
| 7 = Double Play/Out | 16 = Home Run |
| 8 = Foul Ball | 17 = Ball |
| 9 = Double | 18 = Foul Ball |

To use the above chart, each count is multiplied by the number on the discs of the set corresponding to that count. The results are then summed and the sum, which is a number between zero and 18, inclusive, is located on the chart. (The probability of a sum of zero is so small that its corresponding outcome is not shown on the chart.) The chart shows the outcome corresponding to each possible sum. The number on the discs in each set thus represents the weight of the discs in that set. The number of discs 10 is greater than the number of discs 12, which in turn is greater than the number of discs 14. The relative number of discs in the sets affects the probability distribution of the outcomes. In the illustrated embodiment, the relative numbers of discs in each set are selected to approximate the probabilities of various event that occur in a game of baseball.

As described above, the chart illustrates the relationship between the sum of the weighted counts and the possible outcomes. Such a relationship is preferred because it relates a single numeric value to an outcome, and a person can readily determine that numeric value by multiplying each count by its weight and summing the results (or, stated equivalently, by summing the numbers on all upwardly facing discs). Nevertheless, in other embodiments, indicia that is non-numeric or otherwise not readily associable with a numeric value may be used. In such embodiments, a relationship (not shown) exhaustively listing the possible combinations of counts and the possible outcomes may be used. In such embodiments, the weights may not be readily perceivable to a user but exist inherently in the manner in which the combinations are related to the outcomes.

Figure 3A:
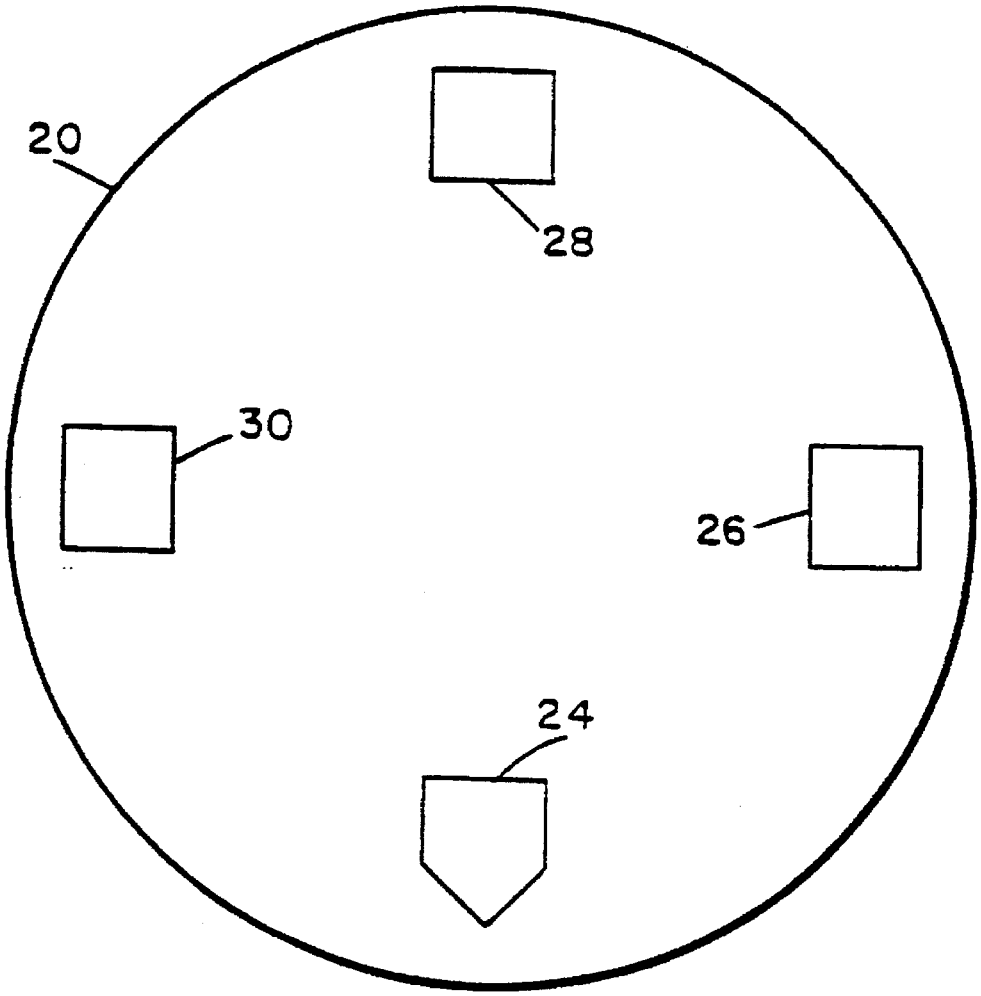
FIG. 3A is a top plan view of a game board for playing a simulated game of baseball.
Figure 3B:
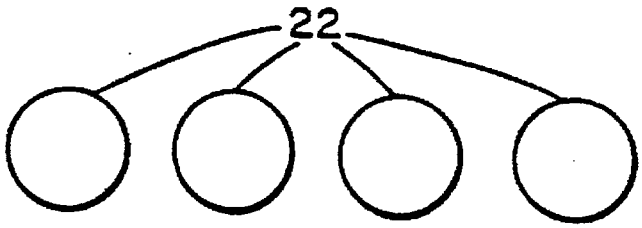
FIG. 3B is a top plan view of playing pieces for a game board.

As illustrated in FIG. 3A, in addition to the eleven discs 10–12, a game board 20 and, as illustrated in FIG. 3B, four playing pieces 22 are used to play the baseball board game. Game board 20 has bases 24, 26, 28 and 30, which are locations on the board appropriately arranged generally in a baseball diamond shape and marked to represent the respective locations of home plate, first base, second base and third base.

One of the discs is flipped in the manner of a conventional coin toss to determine which of two players is at bat first. The player at bat stacks discs 10–12 and tosses or pitches disc 18 at stack 16, as described above. The sum is calculated as described above, and the outcome is determined. In general, the rules of the game are those of conventional baseball. The positions of the players on the bases are marked by placing a player piece 22 on the appropriate one of bases 26–30. Player pieces 22 are advanced from home plate 24 to first base 26 to second base 28 to third base 30 and back to home plate 24 in the conventional manner. Runs and outs are accumulated in the conventional manner, as described in further detail below with respect to the chart. When the player at bat accumulates three outs, the other player takes a turn at bat. The preferred nine innings may be played in this manner.

In accordance with the chart, if the sum equals 10, 14 or 17, the outcome is a "ball." If the sum equals two, eight or 18, the outcome is a "foul ball." If the sum equals three or six, the outcome is a "single." If a player piece 22 is on first base 24, it is advanced to second base 28. If a player piece is on second base 28, it is advanced to third base if a player piece 22 is advanced to second base 28. If a player piece 22 is on third base 30, it is advanced to home plate 24 if a player piece 22 is advanced to third base. In addition, a player piece is placed on first base 26. If the sum equals four, the outcome is a "pop out." If the sum equals five and if no player piece 22 is on third base 30, the outcome is a "ball." If the sum equals five and a player piece 22 is on third base 30, the outcome is a "squeeze play"; the player piece 22 on third base 30 is advanced to home plate 24. If the sum equals seven, the outcome is a "double play" if a player piece 22 is on first base 26 or an "out" if no player piece 22 is on first base 26. If the sum equals nine, the outcome is a "double." Player pieces are advanced two bases, scoring runs if advanced to home plate 24. A player piece is placed on second base 28. If the sum equals 11, the outcome is a "ground out." If the sum equals 12, the outcome is a "ball," but if there is a player piece on first base 26 or second base 28 it is advanced one base as a "steal." If the sum equals 13, the outcome is a "triple." Any player pieces 22 on bases 26, 28 or 30 are advanced to home plate 24 and score runs. A player piece is placed on third base 30. If the sum equals 15, the outcome is a "pop out" or "bunt" and counts as an "out." A player piece 22 on first base 26 is advanced to second base 28. A player piece on second base 28 is advanced to third base 30 if no player piece 22 is on third base 30. If the sum equals 16, the outcome is a "home run." All player pieces on bases 26–30 are advanced home, scoring runs. Another run is scored for the batter.

Figure 4:
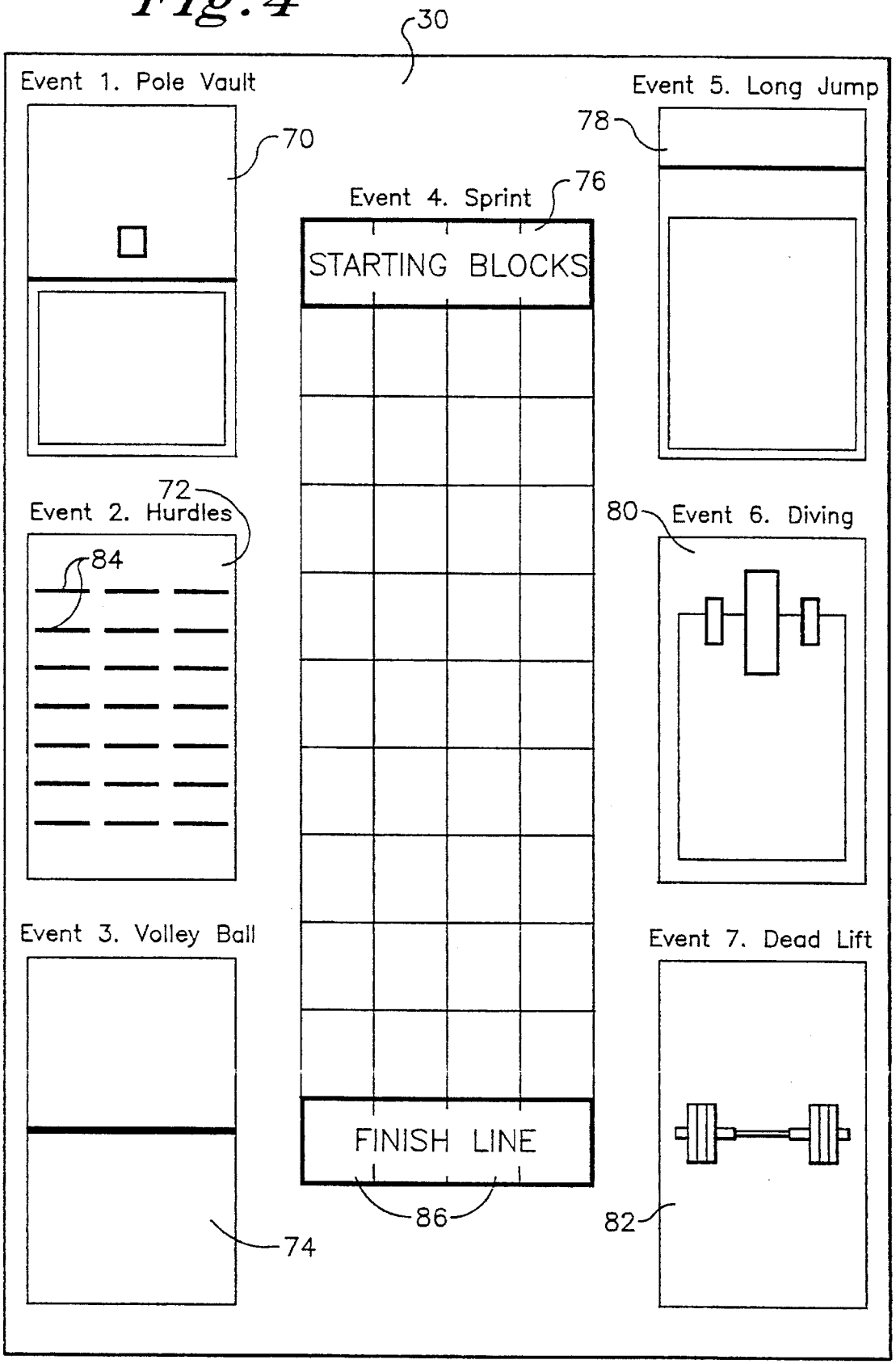
FIG. 4 is a top plan view of a game board for playing a simulated athletic competition.
Figure 5:
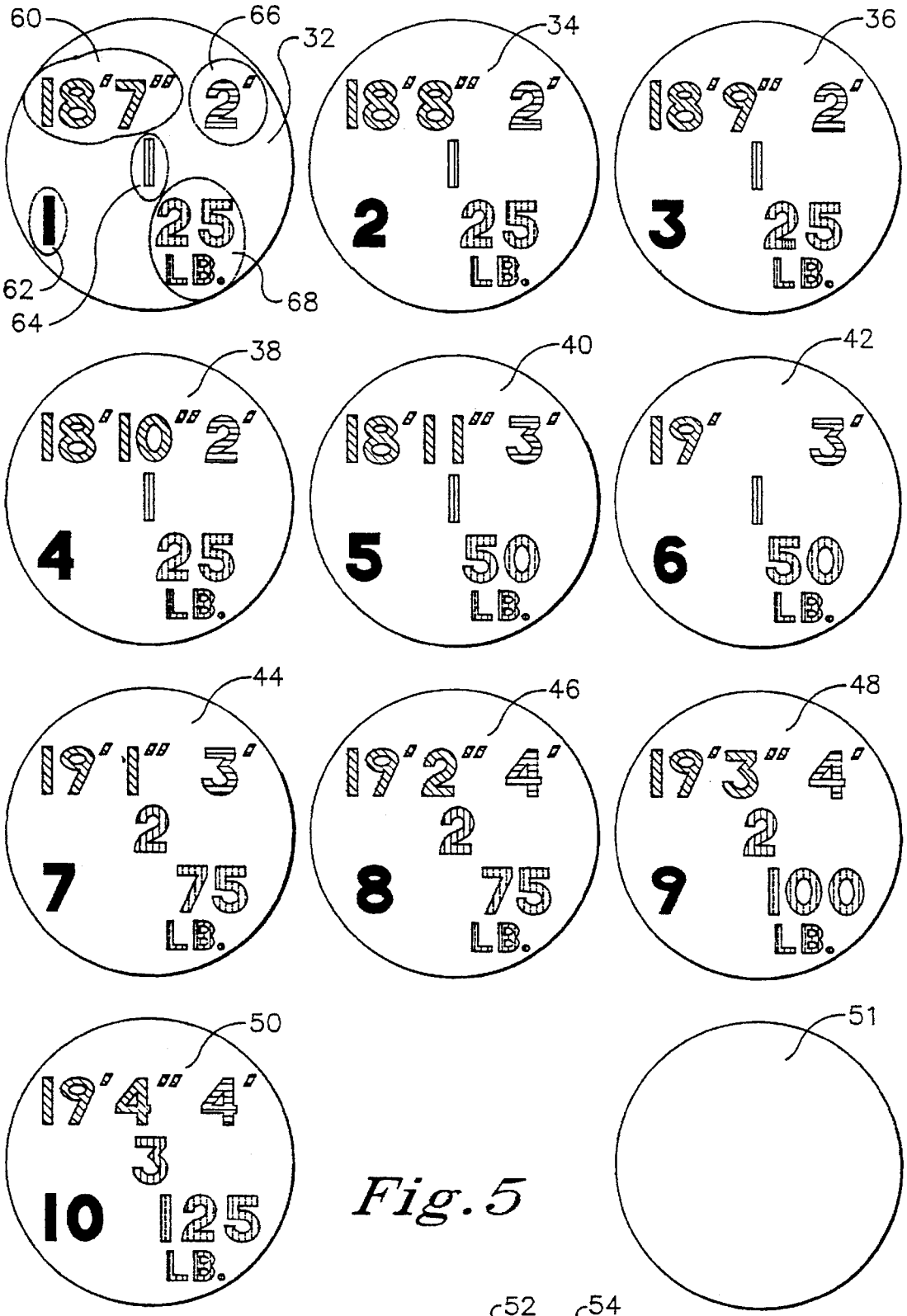
FIGS. 5 and 6 are top plan views of, respectively, discs and playing pieces for the athletic competition game board.
Figure 6:
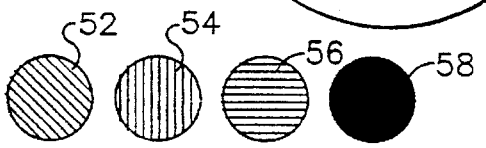

A game that simulates an OLYMPIC® competition may be played using the game board 30 illustrated in FIG. 4, the discs 32, 34, 36, 38, 40, 42, 44, 46, 48, 50 and 51 illustrated in FIG. 5, and the playing pieces 52, 54, 56 and 58 illustrated in FIG. 6.

Discs 32–50 are made of a suitable material, such as cardboard, and disc 51 is made of a material that is thicker and heavier than that of discs 32–50, such as plastic, as described above with respect to FIGS. 1A–B and 2A–B. The obverse or top side of each of discs 32–50 has indicia printed on it. The reverse or bottom side (not shown) are blank and thus not labeled with any of the indicia that appear on the obverse sides of discs 32–50. Each of discs 32–50 has four types of indicia that can be differentiated in part by their color: a Pole Vault height 60, a Hurdles number 62, a Sprint number 64, a Long Jump distance 66 and a Weightlifting weight 68. As represented by the lining in FIG. 5, Pole Vault distance 60 may be green, hurdles number 62 may be black, sprint number 64 may be red, Long Jump distance 66 may be blue, and Weightlifting weight 68 may be purple. Although color is used in the illustrated embodiment as the primary means by which a person can differentiate these indicia types, any suitable means may be used. Note that the relative locations of indicia of types 60–68 is another means by which a person can differentiate them.

Playing pieces 52–58 may be made of any suitable material, such as cardboard and may be differentiated by their color. As represented by the lining in FIG. 6, disc 52 may be green, disc 54 may be red, disc 56 may be blue and disc 58 may be black. Nevertheless, playing pieces 52–58 may have any suitable markings that allow the players to differentiate them. Game board 30 has printed on it seven areas 70, 72, 74, 76, 78, 80 and 82, each of which represents an OLYMPIC® event.

To play the game, each player chooses one of playing pieces 52–58 to represent himself. To determine the order in which the players compete, each player stacks discs 32–50 and tosses disc 51 at the stack in an attempt to topple it. Each player observes the discs that came to rest with their obverse sides upward and totals or sums the Sprint numbers 64. The players compete in the order represented by their totals, with the player having the highest total competing first in each event. (If two or more players have equal totals, they may repeat the stacking and tossing steps.)

To compete in the first event, the Pole Vault, each player places his selected one of playing pieces 52–58 on Pole Vault area 70. The first player stacks discs 32–50 with their obverse sides downward and tosses disc 51 at the stack. The player observes the discs that came to rest with their obverse sides upward and notes the greatest Pole Vault height 60. Pole vault height 60 is marked in units of feet and inches: disc 32 indicates a pole vault height 60 of 18 feet, seven inches; disc 34 indicates a Pole Vault height of 18 feet, eight inches; disc 36 indicates a Pole Vault height of 18 feet, nine inches; disc 38 indicates a Pole Vault height of 18 feet, 10 inches; disc 40 indicates a Pole Vault height of 18 feet, 11 inches; disc 42 indicates a Pole Vault height of 19 feet; disc 44 indicates a Pole Vault height of 19 feet, one inch; disc 46 indicates a Pole Vault height of 19 feet, two inches; disc 48 indicates a Pole Vault height of 19 feet, three inches; and disc 50 indicates a Pole Vault height of 19 feet, four inches. The player may record his number on a suitable scoreboard (not shown). Players take turns performing these steps. The player having the greatest Pole Vault height 60 wins the first event. Players who achieve the same Pole Vault height 60 may each take another turn to break the tie. The players may record the first-place (gold medalist), second-place (silver medalist) and third-place (bronze medalist) on the scoreboard.

To compete in the second event, the Hurdles, each player places his selected one of playing pieces 52–58 on Hurdles area 72. The first player stacks discs 32–50 with their obverse sides downward and tosses disc 51 at the stack. The player observes the discs that came to rest with their obverse sides upward and notes the discs that indicate a Hurdles number 62 greater than six. Hurdles number 62 is a unitless number: disc 32 indicates a Hurdles number 62 of one; disc 34 indicates a Hurdles number 62 of two; disc 36 indicates a Hurdles number 62 of three; disc 38 indicates a Hurdles number 62 of four; disc 40 indicates a Hurdles number 62 of five; disc 42 indicates a Hurdles number 62 of six; disc 44 indicates a Hurdles number 62 of seven; disc 46 indicates a Hurdles number 62 of eight; disc 48 indicates a Hurdles number 62 of nine; and disc 50 indicates a Hurdles number 62 of ten. A result greater than six means that the player cleared the hurdle. Hurdles area 72 has printed on it indicia representing groups of seven hurdles. The player performs the stacking and tossing steps seven times, each time advancing his playing piece to the next hurdle of one of the groups. The player may record the number of hurdles he cleared on a suitable scoreboard. Players take turns performing these steps. The player clearing the most hurdles wins the event. Players who clear the same number of hurdles may each take another turn to break the tie. The players may record the first-place (gold medalist), second-place (silver medalist) and third-place (bronze medalist) on the scoreboard.

To compete in the third event, Volleyball, each player places his selected one of playing pieces 52–58 on Volleyball area 74. Only two players compete against each other at a time. The first player stacks discs 32–50 with their obverse sides downward and tosses disc 51 at the stack. If any discs came to rest with their obverse sides upward, the player is deemed to have successfully hit a volleyball across a net. The second player then stacks discs 32–50 and tosses disc 51 at the stack. If any discs came to rest with their obverse sides upward, that player successfully returned the ball across the net. The first player who fails to flip any of the discs, i.e., make at least one disc come to rest with its obverse side upward, loses the volley. The remaining rules are those of conventional volleyball. For example, only a player who served can score a point in the resulting volley. If the player who served loses that volley, the other player serves next. The players may record the score on a scoreboard. The first player to score five points wins the game. If there are three or more players, the players may play a number of rounds to determine first-place (gold medalist), second-place (silver medalist) and third-place (bronze medalist).

To compete in the fourth event, the Sprint, each player places his selected one of playing pieces 52–58 on Sprint area 76. Sprint area 76 has printed on it indicia representing four tracks 86, each having multiple spaces. Each player may place his playing piece at the "starting block" end of one of tracks 86. The first player stacks discs 32–50 with their obverse sides downward and tosses disc 51 at the stack. The player observes the discs that came to rest with their obverse sides upward and notes the greatest Sprint number 64. Sprint number 64 is marked in unitless numerals: disc 32 indicates a Sprint number 64 of 1; disc 34 indicates a Sprint number 64 of 1; disc 36 indicates a Sprint number 64 of 1; disc 38 indicates a Sprint number 64 of 1; disc 40 indicates a Sprint number 64 of 1; disc 42 indicates a Sprint number 64 of 1; disc 44 indicates a Sprint number 64 of 1; disc 46 indicates a Sprint number 64 of 2; disc 48 indicates a Sprint number 64 of 2; and disc 50 indicates a Sprint number 64 of 3. The player advances his playing piece a number of spaces equal to the greatest Sprint number 64. Players take turns performing these steps. The first player to advance his playing piece to the end of his selected track 86 wins the event. If two players reach the end on the same turn, they may race again to break the tie. The players may record the first-place (gold medalist), second-place (silver medalist) and third-place (bronze medalist) on the scoreboard.

To compete in the fifth event, the Long Jump, each player places his selected one of playing pieces 52–58 on Long Jump area 78. The first player stacks discs 32–50 with their obverse sides downward and tosses disc 51 at the stack. The player observes the discs that came to rest with their obverse sides upward and notes the greatest Long Jump distance 66. Long Jump distance 66 is marked in units of feet: disc 32 indicates a Long Jump distance of two feet; disc 34 indicates a Long Jump distance of two feet; disc 36 indicates a Long Jump distance of two feet; disc 38 indicates a Long Jump distance of two feet; disc 40 indicates a Long Jump distance of three feet; disc 42 indicates a Long Jump distance of three feet; disc 44 indicates a Long Jump distance of three feet; disc 46 indicates a Long Jump distance of four feet; disc 48 indicates a Long Jump distance of four feet; and disc 50 indicates a Long Jump distance of four feet. The player may record his number on the scoreboard. Players take turns performing these steps. The player having the greatest Long Jump distance 66 wins the first event. Players who achieve the same Long Jump distance 66 may each take another turn to break the tie. The players may record the first-place (gold medalist), second-place (silver medalist) and third-place (bronze medalist) on the scoreboard.

To compete in the sixth event, Diving, each player places his selected one of playing pieces 52–58 on Diving area 80. The first player stacks discs 32–50 with their obverse sides downward and tosses disc 51 at the stack. The player counts the number of discs that came to rest with their indicia or top sides upward. The number of discs in this orientation simulates the size of a splash that a diver makes entering the water. A smaller splash, e.g., only one disc in this orientation, indicates a better dive. The player performs the stacking a tossing steps three times, each time recording on a scoreboard the number of discs that came to rest in this orientation. If no discs come to rest with their indicia sides upward, however, the diver is penalized and scores no points. The player having the smallest total number of points wins first-place (gold medalist), with the next smallest taking second-place (silver medalist) and the next smallest taking third-place (bronze medalist).

To compete in the seventh event, Weightlifting, each player places his selected one of playing pieces 52–58 on Weightlifting area 82. The first player stacks discs 32–50 with their obverse sides downward and tosses disc 51 at the stack. The player observes the discs that came to rest with their obverse sides upward and notes the greatest Weightlifting weight 68. Weightlifting weight 68 is marked in units of pounds: disc 32 indicates a Weightlifting weight 68 of 25 pounds; disc 34 indicates a Weightlifting weight 68 of 25 pounds; disc 36 indicates a Weightlifting weight 68 of 25 pounds; disc 38 indicates a Weightlifting weight 68 of 25 pounds; disc 40 indicates a Weightlifting weight 68 of 50 pounds; disc 42 indicates a Weightlifting weight 68 of 50 pounds; disc 44 indicates a Weightlifting weight 68 of 75 pounds; disc 46 indicates a Weightlifting weight 68 of 75 pounds; disc 48 indicates a Weightlifting weight 68 of 100 pounds; and disc 50 indicates a Weightlifting weight 68 of 125 pounds. The player performs the stacking and tossing steps five times, each time recording the greatest Weightlifting weight 68 on the scoreboard. Players take turns performing these steps and sum or total the five weights. The player having the greatest total weight wins the event. Players who achieve the same total weight may each take another turn to break the tie. The players may record the first-place (gold medalist), second-place (silver medalist) and third-place (bronze medalist) on the scoreboard.

An overall champion among the players may be determined by assigning points to the medals and totaling them. A gold medal may be three points. A silver medal may be two points. A bronze medal may be one point. The player having the greatest total is the champion.

It should be noted that discs 32–50 have sets of indicia as described above with respect to the embodiment illustrated in FIG. 1A–B and FIG. 2A–B, in which each set consists of discs having the same indicia as all other discs in the set but different from that of discs in the other sets. The sets may be defined with respect to any of the indicia types. For example, with respect to Sprint number 64: discs 32, 34, 36, 38, 40 and 42 may form a set because each has a Sprint number 64 of one; discs 44, 46 and 48 may form a second set because each has a Sprint number of two; and disc 50 may form a third set because it has a Sprint number of three. With respect to Long Jump distance 66: discs 32, 34, 36, and 38 may form a set because each has a Long Jump distance 66 of two feet; discs 38, 40, 44 and 44 may form a second set because each has a Long Jump distance of three feet; and discs 46, 48 and 50 may form a third set because each has a Long Jump distance of four feet. Sets may similarly be defined with respect to Weightlifting weight 68.

It should also be noted that although in the above-described game, each indicia type is used to generate a random outcome in a different OLYMPIC® event, in other embodiments each indicia type may be used to generate a random outcome in a game that is entirely unrelated to games played using the other indicia types.

Figure 7:
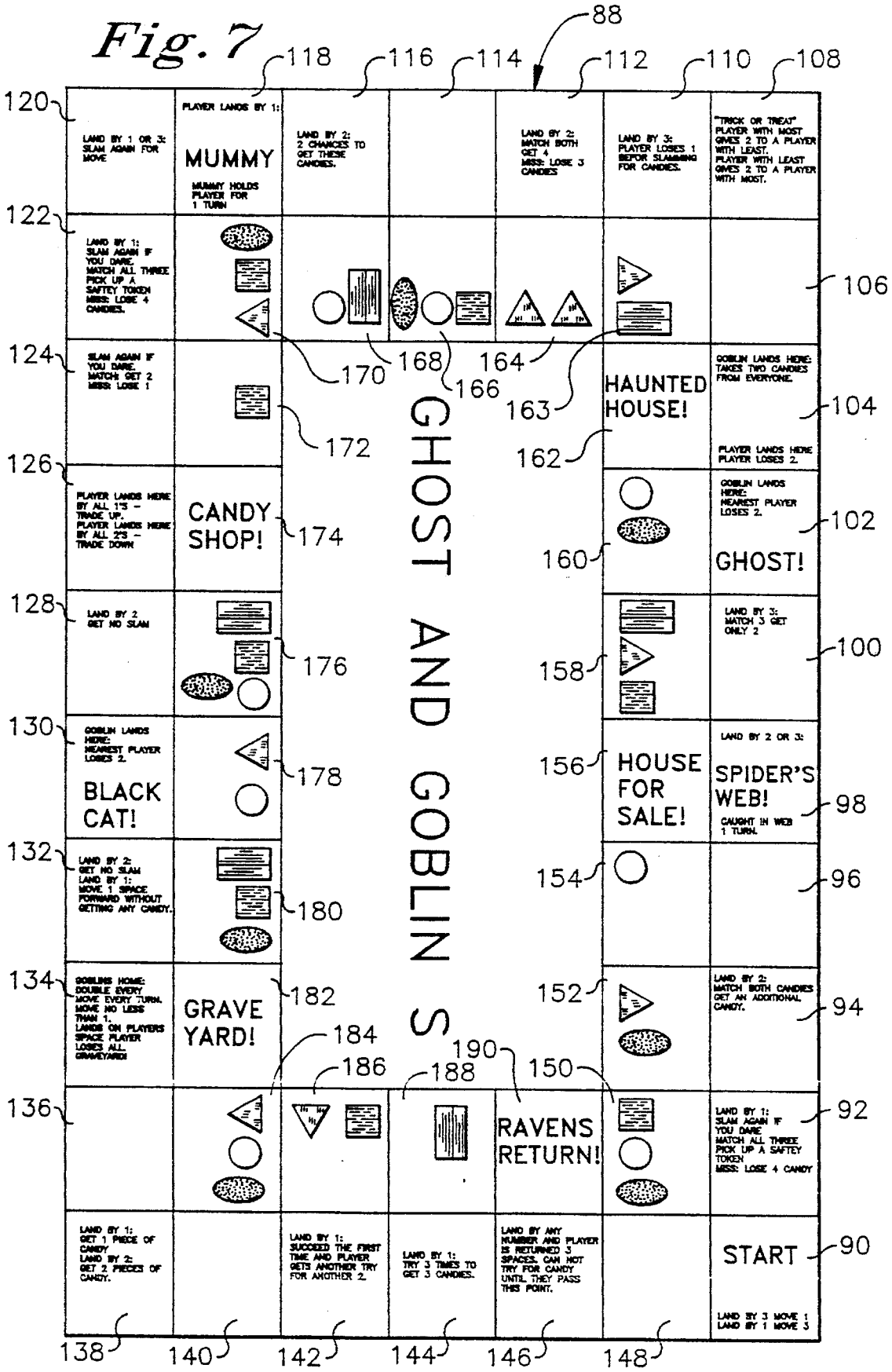
FIG. 7 is a top plan view of a game board for playing a Halloween game.

A Halloween game may be played using the game board 88 illustrated in FIG. 7, the discs 192, 194, 196, 198, 200, 201, 204, 206, 208, 210 and 212 illustrated in FIG. 8, the playing pieces 214, 216, 218 and 220 illustrated in FIG. 9, and the candy pieces 222 shown in FIG. 10. Although only one candy piece 222 is illustrated, the game includes at least about 40, which may be actual or simulated pieces of candy, for which the players compete. The first player to accumulate 13 candy pieces 222 wins the game.

Each of discs 192–210 has printed on its obverse side two indicia types, a number and a symbol: Disc 192 has a "1" and a square; disc 194 has a "2" and a square; disc 196 has a "1" and a circle; disc 198 has a "2" and a circle; disc 200 has a "1" and an ellipse; disc 202 has a "2" and an ellipse; disc 204 has a "1" and a triangle; disc 206 has a "2" and a triangle; disc 208 has a "3" and a triangle; and disc 210 has a "1" and an oblong rectangle. As in the embodiments described above, the reverse sides of discs 192–210 are blank. Discs 192–212 may be made of cardboard, and disc 212 may be made of a thicker and heavier material, such as plastic.

Game board 88 has printed on it an outer track of square spaces 90, 92, 94, 96, 98, 100, 102, 104, 106, 108, 110, 112, 114, 116, 118, 120, 122, 124, 126, 128, 130, 132, 134, 136, 138, 140, 142, 144, 146 and 148. Spaces 90–148 simulate a sidewalk. Game board 88 also has printed on it an inner group of square spaces 150, 152, 154, 156, 158, 160, 162, 163, 164, 166, 168, 170, 172, 174, 176, 178, 180, 182, 184, 186, 188 and 190. Spaces 150–190 simulate houses at which the players stop to "trick-or-treat" and other places at which events can occur that add or remove candy pieces 222 from a player's total. Certain ones of spaces 150–190 that represent houses have one or more symbols of the type on discs 192–210.

To play the game, each player chooses one of playing pieces 214, 216 and 218 to represent himself and places it on start space 90. Playing piece 220 represents the goblin, which can take candy from the players as described below. The players place the goblin on space 134. Space 134 represents the sidewalk in front of the "graveyard," represented by space 182, which is the goblin's home. To determine the order in which the players begin taking turns, each player stacks discs 192–210 and tosses disc 212 at the stack. Each player observes the discs that came to rest with their obverse sides upward and totals or sums the numbers. The player having the highest total takes the first turn, the player having the second highest total takes the next turn, and so forth.

The first player stacks discs 192–210 and tosses disc 212 at the stack. The player observes the discs that came to rest with their obverse sides upward and notes the highest number. The player moves his playing piece that number of spaces counterclockwise along the outer track. Each time a player moves his playing piece a number of spaces, the players also move the goblin twice as many spaces in the opposite direction along the outer track. When a player's playing piece lands on one of spaces 90–148, the player reads and follows the instructions, if any, that are printed on the space. As described below, most spaces require that a player perform the stacking and tossing steps again, which will determine the effect on a player's total number of candy pieces 222. Unless the space instructs otherwise, a player must perform the stacking and tossing steps again and observe the discs that come to rest with their obverse sides up. If all of the symbols that are printed on the one of spaces 150–190 that is closest to the space on which the player's playing piece is situated are also visible on the discs, the player takes a number of candy pieces 222 equal to the number of symbols. For example, if a player lands on space 152, and the stacking and tossing steps reveal at least one triangle and at least one ellipse, the player receives two candy pieces 222. Nevertheless, if the goblin lands on the same square as any player, that player loses all of his candy pieces 222. The instructions for spaces 90–148 will now be described individually.

If a player lands on space 92 by having moved any number of spaces other than one, he must perform the stacking and tossing steps. If the result reveals the symbols shown in space 150, i.e., at least one square, at least one circle and at least one ellipse, the player receives three candy pieces 222. If the player landed on space 92 by having moved exactly one space, he is not required to perform the stacking and tossing steps but may do so at his election. If the player elects to do so and the result reveals at least one square, at least one circle and at least one ellipse, the player receives a safety token (not shown). If any other result, the player loses four candy pieces 222. A safety token may be a cardboard disc or any other suitable device that players can differentiate from discs 192–212, playing pieces 214–218 and goblin 220. A player may use a safety token at any time during the game to counter any result that mandates the player lose one or more candy pieces 222. Once the player uses a safety token, he loses it.

If a player lands on space 94, he must perform the stacking and tossing steps. If the result reveals the symbols shown in space 152, i.e., at least one triangle and at least one ellipse, the player receives two candy pieces 222. If the player landed on space 92 by having moved exactly two spaces, he receives a third or bonus token piece 222.

If a player lands on space 96, he must perform the stacking and tossing steps. If the result reveals the symbols shown in space 154, i.e., at least one circle, the player receives one token piece 222.

If a player lands on space 98 by having moved exactly two or exactly three spaces, he does not perform the stacking and tossing steps and loses his next turn. If a player lands on space 98 by having moved any number of spaces other than exactly two or exactly three, he does nothing.

If a player lands on space 100, he must perform the stacking and tossing steps. If the result reveals the symbols shown in space 158, i.e., at least one oblong rectangle, at least one square and at least one triangle, the player receives three candy pieces 222, unless the player landed on space 100 by having moved two spaces, in which case the player receives only two candy pieces 222.

If a player lands on space 102, he must perform the stacking and tossing steps. If the result reveals the symbols shown in space 160, i.e., at least one circle and at least one ellipse, the player receives two candy pieces 222. If the goblin lands on space 102, the player having the playing piece situated nearest space 102 loses two candy pieces 222.

If a player lands on space 104, he loses two candy pieces 222. If the goblin lands on space 104, every player loses two candy pieces 222.

If a player lands on space 106, he must perform the stacking and tossing steps. If the result reveals the symbols shown in space 163, i.e., at least one oblong rectangle and at least one triangle, the player receives two candy pieces 222.

If a player lands on space 108 the player does not perform the stacking and tossing steps. If the player has a number of candy pieces 222 that is not less than that of any other player, the player must give two candy pieces 222 to one of the other players who has a lesser or equal number of candy pieces 222. If the player has a number of candy pieces 222 that is less than that of all other players, the player must give two candy pieces 222 to the player having the greatest number of candy pieces 222.

If a player lands on space 110 by having moved exactly three spaces, he loses one candy piece 222 before performing the stacking and tossing steps. If a player lands on space 110 by having moved any number of spaces other than three, he must perform the stacking and tossing steps. In either event, if the result reveals the symbols shown in space 163, the player receives two candy pieces 222.

If a player lands on space 112 by having moved any number of spaces other than two, he must perform the stacking and tossing steps. If the result reveals the symbols shown in space 164, i.e., at least two triangles, the player receives two candy pieces 222. If the player landed on space 92 by having moved exactly two spaces, he receives third and fourth bonus candy pieces 222. If any other result, however, the player loses three candy pieces 222.

If a player lands on space 114, he must perform the stacking and tossing steps. If the result reveals the symbols shown in space 166, i.e., at least one ellipse, at least one circle and at least one square, the player receives three candy pieces 222.

If a player lands on space 116, he must perform the stacking and tossing steps. If the result reveals the symbols shown in space 168, i.e., at least one circle and at least one oblong rectangle, the player receives two candy pieces 222. If the player lands on space 116 by having moved exactly two spaces, he must perform the stacking and tossing steps again. If the result reveals the symbols shown in space 168, the player receives two candy pieces 222.

If a player lands on space 118, he must perform the stacking and tossing steps. If the result reveals the symbols shown in space 168, i.e., at least one ellipse, at least one square and at least one triangle, the player receives three candy pieces 222. In addition, if the player lands on space 118 by having moved exactly one space, he loses his next turn.

If a player lands on space 120 by having moved exactly one or exactly three spaces, he must perform the stacking and tossing steps, but not for the purpose of attempting to receive candy pieces 222. Rather, the player notes the highest number that the discs reveal and moves his playing piece that number of spaces. If a player lands on space 120 by having moved any number of spaces other than exactly one or exactly three, he does nothing.

If a player lands on space 122 by having moved any number of spaces other than one, he must perform the stacking and tossing steps. If the result reveals the symbols shown in space 170, i.e., at least one triangle, at least one square and at least one ellipse, the player receives three candy pieces 222. If the player landed on space 92 by having moved exactly one space, he is not required to perform the stacking and tossing steps but may do so at his election. If the player elects to do so and the result reveals the symbols shown in space 170, the player receives a safety token (not shown). If any other result, the player loses four candy pieces 222.

If a player lands on space 124, he is not required to perform the stacking and tossing steps but may do so at his election. If the player elects to do so, and the result reveals the symbol shown in space 172, i.e., at least one square, the player receives two candy pieces 222. If any other result, the player loses one candy piece 222.

If a player lands on space 126, and the results of the tossing step from which the player calculated the number of spaces to move revealed only the number "1" and no other numbers, the player must trade all his candy pieces 222 with any player who has a greater number of candy pieces 222. If a player lands on space 126, and the results of the tossing step from which the player calculated the number of spaces to move revealed only the number "2" and no other numbers, the player must trade all his candy pieces 222 with any player who has a lesser number of candy pieces 222.

If a player lands on space 128 by having moved any number of spaces other than exactly two, he must perform the stacking and tossing steps. If the result reveals the symbols shown in space 176, i.e., at least one ellipse, at least one circle, at least one square and at least one oblong rectangle, the player receives four candy pieces 222.

If a player lands on space 130, he must perform the stacking and tossing steps. If the result reveals the symbols shown in space 178, i.e., at least one circle and at least one triangle, the player receives two candy pieces 222. If the goblin lands on space 130, the player having the playing piece situated nearest space 102 loses two candy pieces 222.

If a player lands on space 132 by having moved any number of spaces other than exactly one, he must perform the stacking and tossing steps. If the result reveals the symbols shown in space 180, i.e., at least one ellipse, at least one square and at least one oblong rectangle, the player receives three candy pieces 222. If a player lands on space 132 by having moved exactly one space, he does not perform the stacking and tossing steps and moves his playing piece on additional space.

If a player lands on space 134, he loses two candy pieces 222. If the goblin lands on space 134, every player loses two candy pieces 222.

If a player lands on space 136, he must perform the stacking and tossing steps. If the result reveals the symbols shown in space 184, i.e., at least one ellipse, at least one circle and at least one triangle, the player receives three candy pieces 222.

If a player lands on space 138, the player does not perform the stacking and tossing steps. If the player lands on space 138 by having moved exactly one space, the player receives one candy piece 222. If the player lands on space 138 by having moved exactly two spaces, the player receives two candy pieces 222.

If a player lands on space 140, he must perform the stacking and tossing steps. If the result reveals the symbols shown in space 184, the player receives three candy pieces 222.

If a player lands on space 142, he must perform the stacking and tossing steps. If the result reveals the symbols shown in space 186, i.e., at least one square and at least one triangle, the player receives two candy pieces 222. In addition, if the player lands on space 142 by having moved exactly one space, and if the player succeeded in matching the symbols shown in space 186, the player must again perform the stacking and tossing steps. If the player again successfully matches the symbols, the player receives another two candy pieces 222.

If a player lands on space 144, he must perform the stacking and tossing steps. If the result reveals the symbol shown in space 188, i.e., at least one oblong rectangle, the player receives one candy piece 222. In addition, if the player lands on space 144 by having moved exactly one space, the player performs the stacking and tossing steps an additional two times, each time receiving three candy pieces 222 if he successfully matches the symbols shown in space 188.

If a player lands on space 146, the player must move back, i.e., clockwise, three spaces to space 140, and he may not perform the stacking and tossing steps to attempt to receive candy pieces 222 when the player arrives at space 140. If, on a subsequent turn, that player moves only one or two spaces, to spaces 142 or 144, the player may not receive any candy pieces 222 at those spaces. If, on a subsequent turn, that player again lands on space 146, the player is again moved back three spaces. A player who lands on space 146 thus may not receive any candy pieces 222 until he has passed space 146.

If a player lands on space 148, he must perform the stacking and tossing steps. If the result reveals the symbols shown in space 150, i.e., at least one ellipse, at least one circle and at least one square, the player receives three candy pieces 222.

If a player lands on space 90, the player does not perform the stacking and tossing steps. If the player lands on space 90 by having moved exactly one space, the player immediately moves three additional spaces. If the player lands on space 90 by having moved exactly three spaces, the player immediately moves one additional space.

In summary, in the Halloween game described above, indicia of a first type, a number, are used to determine the number of spaces to move a playing piece on a game board, and indicia of a second type, a symbol, are used to determine the outcome of moving the playing piece to that space. The outcome may be to add or subtract a number of token pieces, such as candy pieces 222, to a player's total. Although in the Halloween game the player generally performs the stacking and tossing steps a first time to determine the number of spaces to move and a second time to determine the outcome, in other types of games, a player may perform these steps only a single time, and use the indicia of both types that are revealed as a result.

It will be evident that there are additional embodiments and applications that are not disclosed in the detailed description but that clearly fall within the scope and spirit of the present invention. The specification is, therefore, not intended to be limiting, and the scope of the invention is to be limited only by the following claims.

What is claimed is:

1. A method for using a plurality of sets of discs to randomly select an outcome from a predetermined set of outcomes, each set consisting of at least one disc, each disc in said set having an indicia side and a non-indicia side, said indicia side of each said disc in a set having a plurality of indicia, each of a different indicia type than other indicia of said disc and of the same indicia type as indicia of all other discs in said sets, the method comprising the steps of:

stacking said plurality of discs;

impacting said stack with a disc; and determining said outcome in response to said indicia of one indicia type on all discs resting in an orientation in which said indicia side of said disc is visible.

2. The method claimed in claim 1, wherein:

said indicia of said one indicia type are numeric values; and said step of determining said outcome comprises selecting the highest numeric value.

3. The method claimed in claim 1, wherein:

said indicia of one said indicia type consist of numeric values; and said step of determining said outcome comprises counting the number of discs having numeric values in a predetermined range.

4. The method claimed in claim 1, wherein said indicia of one said indicia type consist of the same indicia as said indicia of every other said disc in said set and different from said indicia of said same indicia type of said discs in every other said set.

5. The method claimed in claim 1, wherein one of said indicia types indicates a measure of distance.

6. The method claimed in claim 1, wherein one of said indicia types indicates a measure of weight.

7. A method for playing a game simulating competition among a plurality of players in a plurality of athletic events, comprising the steps of:

providing a plurality of sets of discs for randomly selecting an outcome from a predetermined set of outcomes, each set consisting of at least one disc, each disc in said set having an indicia side and a non-indicia side, said indicia side of each said disc in a set having a plurality of indicia, each of a different indicia type than other indicia of said disc and of the same indicia type as indicia of all other discs in said sets, each indicia type corresponding to one of said athletic events;

said players taking turns in each athletic event, wherein taking a turn comprises the steps of:

stacking said plurality of discs;

impacting said stack with a disc; and determining said outcome of a turn in response to said indicia of one of said indicia types on all discs resting in an orientation in which said indicia side of said disc is visible; and selecting a winner among said players of each said athletic event in response to said outcome of all of said turns.

8. The method claimed in claim 7, wherein:

one said indicia type corresponding to one athletic event indicates a measure of distance, said indicia of said one said indicia type of each said disc indicating a different distance than said indicia of every other said disc; and said determining step associated with said one athletic event comprises the step of selecting a greatest distance.

9. The method claimed in claim 8, wherein:

said athletic event is The Pole Vault, and said step of taking a turn comprises each player performing said stacking, impacting, and determining steps a plurality of times, each time corresponding to attempting a pole vault;

said method further comprises the step of providing a plurality of playing pieces and a game board having indicia indicating a pole vault;

said step of taking a turn further comprises placing a playing piece on said indicia indicating a pole vault; and said step of selecting a winner comprises selecting a player who causes said discs to indicate said greatest distance more times than all other said players.

10. The method claimed in claim 7, wherein:

one said indicia type corresponding to one athletic event is a numeric value, said numeric value indicated by each said disc being different from said numeric value indicated by every other said disc and differing by a value of one from at least one other disc; and said determining step associated with said one athletic event comprises the step of determining whether at least one disc indicates a numeric value greater than the median value of said numeric values.

11. The method claimed in claim 9, wherein:

said athletic event is The Hurdles, and said step of taking a turn comprises each player performing said stacking, impacting, and determining steps a plurality of times, each time corresponding to attempting a hurdle;

said method further comprises the step of providing a plurality of playing pieces and a game board having indicia indicating a plurality of hurdles;

said step of taking a turn further comprises sequentially moving a playing piece to said indicia indicating a next hurdle; and said step of selecting a winner comprises selecting a player who causes said discs to indicate a numeric value greater than the median value of said numeric values more times than all said other players.

12. The method claimed in claim 7, wherein:

said determining step associated with said one athletic event comprises the step of determining whether no discs are resting in an orientation in which said indicia side of said disc is visible.

13. The method claimed in claim 12, wherein:

said athletic event is Volleyball, and said step of taking a turn comprises each player performing said stacking, impacting, and determining steps a plurality of times, each time corresponding to attempting a return of a volleyball, an outcome of no discs resting in an orientation in which said indicia side of said disc is visible corresponding to said player not successfully returning said volleyball;

said method further comprises the step of providing a plurality of playing pieces and a game board having indicia indicating a volleyball court;

said step of taking a turn further comprises placing a playing piece on said indicia indicating a volleyball court; and said step of selecting a winner comprises selecting a player who causes said outcome to indicate successfully returning said volleyball more times than all other said players.

14. The method claimed in claim 7, wherein:

one said indicia type corresponding to one athletic event is a numeric value, said numeric values being the same as numeric values of every other said disc in said set and different from numeric values of said same indicia type of said discs in every other said set; and said determining step associated with said one athletic event comprises the step of selecting a highest numeric value.

15. The method claimed in claim 14, wherein:

said athletic event is The Sprint, and said step of taking a turn comprises each player performing said stacking, impacting, and determining steps a plurality of times, each time corresponding to sprinting a portion of a total distance;

said method further comprises the step of providing a plurality of playing pieces and a game board having indicia indicating a plurality of spaced evenly spaced along said total distance;

said step of taking a turn further comprises advancing a playing piece a number of spaces on said game board equal to said highest numeric value; and said step of selecting a winner comprises selecting a player who advances said playing piece said total distance before all other players.

16. The method claimed in claim 14, wherein:

said athletic event is The Long Jump, and said step of taking a turn comprises each player performing said stacking, impacting, and determining steps exactly one time, said time corresponding to attempting a jump, and said highest numeric value indicates a measure of distance jumped;

said method further comprises the step of providing a plurality of playing pieces and a game board having indicia indicating a jumping area;

said step of taking a turn further comprises placing a playing piece on said indicia indicating a jumping area; and said step of selecting a winner comprises selecting a player who causes the discs to indicate said highest numeric value.

17. The method claimed in claim 14, wherein:

said athletic event is Weight Lifting, and said step of taking a turn comprises each player performing said stacking, impacting, and determining steps a plurality of times, each time corresponding to attempting a lift, and said highest numeric value indicates a measure of weight lifted;

said method further comprises the step of providing a plurality of playing pieces and a game board having indicia indicating a weight lifting area;

said step of taking a turn further comprises placing a playing piece on said indicia indicating a weight lifting area; and said step of selecting a winner comprises selecting a player who causes the discs to indicate said highest numeric value more times than all other players.

18. The method claimed in claim 7, wherein:

said determining step associated with said one athletic event comprises the step of determining the number of discs resting in an orientation in which said indicia side of said disc is visible.

19. The method claimed in claim 18, wherein:

said athletic event is Diving, and said step of taking a turn comprises each player performing said stacking, impacting, and determining steps a plurality of times, each time corresponding to attempting a dive;

said method further comprises the step of providing a plurality of playing pieces and a game board having indicia indicating a diving pool;

said step of taking a turn further comprises placing a playing piece on said indicia indicating a diving pool; and said step of selecting a winner comprises selecting a player who causes the least number of said number of discs greater than zero to rest in an orientation in which said indicia side of said disc is visible.

20. A method for playing a game, comprising the steps of:

providing a game board, and a plurality of sets of discs for randomly selecting an outcome from a predetermined set of outcomes, each set of discs consisting of at least one disc, each disc in said set having an indicia side and a non-indicia side, said indicia side of each said disc in a set having a plurality of indicia, each of a different indicia type than other indicia of said disc and of the same indicia type as indicia of all other discs in said sets, one said indicia type corresponding to a number of spaces, said game board having a plurality of spaces, each having a corresponding indicia group comprising indicia of at least one of said indicia types;

stacking said plurality of discs;

impacting said stack with a disc;

selecting a space in response to said indicia of a first one of said indicia types on all discs resting in an orientation in which said indicia side of said disc is visible; and determining an outcome in response to a comparison of said indicia of a second one of said indicia types on all discs resting in an orientation in which said indicia side of said disc is visible with said indicia of said indicia group of the selected space.

21. The method claimed in claim 20, further comprising, before said determining step, the steps of:

again stacking said plurality of discs; and again impacting said stack with a disc.

22. The method claimed in claim 20, wherein:

said providing step further comprises providing a plurality of player pieces positionable on said spaces, and each space is adjacent to another space, and said spaces form a path; and said selecting step comprises moving a player piece from a space on which it is placed a number of spaces along said path.

23. The method claimed in claim 22, wherein:

said indicia of said first indicia type are numeric values; and said number of spaces is equal to a greatest numeric value.

24. The method claimed in claim 22, wherein:

said providing step further comprises providing a plurality of token pieces; and said determining step comprises altering a count of token pieces associated with said moved player piece.

25. The method claimed in claim 24, wherein said altering step comprises adding a number of token pieces to said count of token pieces equal to the number of indicia in said indicia group.

26. The method claimed in claim 24, further comprising the step of selecting a winner among said players in response to a comparison of the number of token pieces associated with each player with the number of token pieces associated with all other players.

27. The method claimed in claim 24, wherein said token pieces are candy.

* * * * *